US010637198B2

(12) United States Patent
Pham et al.

(10) Patent No.: US 10,637,198 B2
(45) Date of Patent: Apr. 28, 2020

(54) ANGLED PLUG CONNECTION AND METHOD FOR ITS PRODUCTION

(71) Applicant: Lisa Draexlmaier GmbH, Vilsbiburg (DE)

(72) Inventors: Thi-Thanh-Truc Pham, Vilsbiburg (DE); Christian Wimmer, Schalkham (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 84 days.

(21) Appl. No.: 15/791,481

(22) Filed: Oct. 24, 2017

(65) Prior Publication Data

US 2018/0115124 A1 Apr. 26, 2018

(30) Foreign Application Priority Data

Oct. 25, 2016 (DE) ..... 10 2016 120 304

(51) Int. Cl.
*H01R 13/56* (2006.01)
*H01R 24/20* (2011.01)
(Continued)

(52) U.S. Cl.
CPC ..... *H01R 24/20* (2013.01); *H01R 13/113* (2013.01); *H01R 13/567* (2013.01); *H01R 13/432* (2013.01); *H01R 13/4361* (2013.01); *H01R 13/506* (2013.01); *H01R 13/6275* (2013.01); *H01R 2103/00* (2013.01)

(58) Field of Classification Search
CPC .... H01R 13/567; H01R 24/20; H01R 13/113; H01R 13/11; H01R 13/4361; H01R 13/506
See application file for complete search history.

(56) References Cited

U.S. PATENT DOCUMENTS 6,250,952 B1 * 6/2001 Shiga ..... F42B 3/188 439/466
6,435,894 B2 * 8/2002 Little ..... H01R 13/639 439/188

(Continued)

FOREIGN PATENT DOCUMENTS

DE 69704555 T2 9/2001
DE 102015104377 9/2016
DE 102015104378 9/2016

*Primary Examiner* — Felix O Figueroa
(74) *Attorney, Agent, or Firm* — Burris Law, PLLC

(57) ABSTRACT

A plug connector, particularly a high-current plug connector, is provided that includes at least one electrical contact part having a sleeve with a receiving space on an inner side for receiving a plug-in contact that is inserted along a longitudinal axis of the plug connector. The electrical contact part further includes at least one contact spring attached to the inner side of the sleeve that is in sliding contact with a locking bolt capable of being guided in the sleeve between a first end position and a second end position. The plug connector includes a plug casing accommodating the contact part having at least one cable guide branching off essentially perpendicularly to the longitudinal axis of the plug connector. An electric line is attached to the contact part being guidable from the plug casing in a direction essentially perpendicular to the longitudinal axis of the plug connector.

17 Claims, 2 Drawing Sheets

(51) Int. Cl.

| | |
|---|---|
| ***H01R 13/11*** | (2006.01) |
| *H01R 13/436* | (2006.01) |
| *H01R 103/00* | (2006.01) |
| *H01R 13/506* | (2006.01) |
| *H01R 13/627* | (2006.01) |
| *H01R 13/432* | (2006.01) |

(56) References Cited

U.S. PATENT DOCUMENTS

| | | | | |
|---|---|---|---|---|
| 6,837,745 | B2 * | 1/2005 | Takada | H01R 13/562 439/521 |
| 7,086,908 | B2 * | 8/2006 | Fukuzaki | H01R 13/42 439/521 |
| 9,722,328 | B2 * | 8/2017 | Wimmer | H01R 4/489 |
| 2005/0181664 | A1 | 8/2005 | Fukuzaki et al. | |

* cited by examiner

ANGLED PLUG CONNECTION AND METHOD FOR ITS PRODUCTION

CROSS-REFERENCE TO RELATED APPLICATIONS

This application claims priority to and the benefit of German Patent Application No. DE 10 2016 120 304.1 filed on Oct. 25, 2016. The disclosure of the above application is incorporated herein by reference.

FIELD

The present disclosure relates to a plug connector, particularly a high-current plug connector that is particularly well suited for high-current plug connections in an on-board electrical system of a vehicle such as a motor vehicle, hybrid or electric vehicle. The present disclosure also relates to a method of producing such a plug connector.

BACKGROUND

The statements in this section merely provide background information related to the present disclosure and may not constitute prior art.

A contact part is known in DE 10 2015 104 377 A1 that has a sleeve forming a receiving space on its inner side for a plug-in contact to be inserted in a plug-in direction. The contact part also includes a contact spring affixed to the inner side of the sleeve and a locking bolt that is displaceable in the sleeve between a first end position and a second end position and is in sliding contact with the one or more contact springs. Depending on its position between the two end points, the locking bolt presses against the one or more contact springs to a varying degree in the direction of the receiving space for the plug-in contact. However, it is desirable to have a plug casing that is compatible with the locking mechanism via the locking bolt to create a plug connector in this way.

In addition, a plug connector is known in DE 10 2015 104 378 A1 that includes a locking mechanism to lock the plug connector to a socket part or socket casing, commonly referred to as a header. The plug connector has a plug casing, with at least one contact part accommodated in the plug casing. The locking mechanism therein has a first locking element and a second locking element in positive engagement with one another at least in a direction of movement of the locking mechanism. Furthermore, the contact part has a displaceable locking bolt to set a contact force exerted on a plug-in contact of the socket part that can be inserted into the contact part, depending on a position of the control element. Moreover, the second locking element is in positive engagement with the locking bolt. However, enhanced compatibility with regard to installation space would be desirable here.

SUMMARY

The present disclosure provides a plug connector that is highly compatible with an installation space, using the simplest possible constructional means.

In one form, the present disclosure includes the plug connector with the features of the independent claim. Advantageous further developments of the present disclosure are specified in the dependent claims, the description and the accompanying drawings.

A plug connector according to the present disclosure, which in particular may be a high-current plug connector, has an electrical contact part (single-pole type) or several contact parts (bipolar or multipolar types) as described in detail, for example, in the aforementioned DE 10 2015 104 377 A1 and DE 10 2015 104 378 A1. The content of these applications in relation to the structure of the contact parts is incorporated herein by reference thereto. The contact part may have a current-carrying capacity of up to 120 A. It has a sleeve with a receiving space on its inner side for a plug-in contact to be inserted along a longitudinal axis of the plug connector or in a direction of insertion. It also has at least one contact spring affixed to the inner side of the sleeve. The contact spring is in sliding contact with a locking bolt that is displaceable or guidable in the sleeve between a first end position and a second end position.

According to the present disclosure, a plug casing accommodating the contact part has at least one cable guide branching off essentially perpendicularly to the longitudinal axis of the plug connector. An electric line that has been or may be attached to the contact part may be guided via the cable guide out of the plug casing essentially perpendicularly to the plug connector's longitudinal axis. In other words, the plug casing and/or the contact part is/are configured to connect the line to the contact part in such a way that in relation to a longitudinal axis of the plug connector, along which the plug-in contact is also inserted in the plug-in direction, the line can be guided out of the plug casing approximately at right angles, i.e. at an angle of ±90° to the plug connector's longitudinal axis.

This configuration in accordance with the present disclosure allows the angled plug connector to be adapted to diverse installation spaces, particularly in a vehicle, which imparts to the plug connector a high degree of compatibility with the installation space.

A particularly advantageous further development of the present disclosure provides that the contact part, referred to a flat side, i.e. a base and/or cover side, of the plug casing is arranged standing or lying on a narrow side in the plug casing. In other words, the flat sides of the plug casing and of the contact part are in perpendicular arrangement relative to one another and/or they enclose an angle of ±90°. By this means a contact part known from the applications mentioned above can be (further) used, since the contact part has a contact tab connecting with the receiving space with the same orientation. This makes it possible to use the same contact part to provide an angled plug connector, which keeps the costs of provision relatively low due to common parts.

To meet requirements of automotive engineering concerning vibration resistance and confirmation of a correctly mounted plug connection, it is advantageous if a plug casing lock, also referred to as a CPA (connector position assurance), is displaceably accommodated in the plug casing and at least partially grasps the contact part and has a recess for a cable guide to guide the line out in a direction perpendicular to the direction of insertion or to the longitudinal axis of the plug connector. Thus, sections of the plug casing lock are arranged between the contact part and the plug casing. The plug casing lock is displaceable relative to the plug casing and also to the plug contact part. This plug connector lock secures the plug connection and indicates to the installer that the plug connection has been correctly installed.

To allow the locking bolt of the contact part to be actuated even when the contact part and the plug casing lock are accommodated in the plug casing, the plug casing lock may have at least one locking arm, which in one form is resilient, that in the installed state positively grasps an end of the locking bolt projecting over the sleeve, in order to carry it along in a receiving slot. Thus, moving the plug casing lock may cause the locking bolt to be moved along via the locking arm, since they are connected together in a positive fit. In the installed state the locking arm extends from a main body, which also contains the recess for the cable guide, into a direction opposite the direction of insertion, i.e. along the longitudinal axis of the plug connector. Since the plug casing lock can be displaced relative to the plug casing and to the contact part, the locking bolt engaging with the receiving slot can be moved along via the locking arm by a movement of the plug casing lock.

To allow the contact part to be clamped fast or held securely and to provide reliable meshing of the receiving slot and the end of the locking bolt, the locking arm may approach the contact part or the longitudinal axis of the plug connector at a slant from a direction opposite the direction of insertion. In other words, the locking arm can extend away from the main body in such a manner that it encloses an angle with the plug connector's longitudinal axis. Thus the locking arm is already biased toward the contact part by its linkage to the main body. By this means, in addition to the locking bolt the contact part itself is also clamped fast either between the locking arm and the inner side of the plug casing or between two complementary locking arms.

For the installation, it has proved to be advantageous for the plug casing to be closed by a plug casing cap to hold the contact part to an end face on the line side. The plug casing cap, for example, may press against the contact part on the line side end and hold it in place in this way. In this way, the plug casing cap also simultaneously functions as a secondary lock of the contact part.

In one form, the plug casing cap holds the contact part securely in place but at the same time allows movement of the plug casing lock relative to the contact part. In other words, the plug casing lock in the installed state can be moved relative to the plug casing cap, for instance by being moved past it. For a portion of the plug casing lock, however, the plug casing cap forms a stop, with the result that the plug casing lock is movable relative to the cap but is ultimately secured against falling out or being pulled out.

The plug connector can be mounted in an especially simple manner if the plug casing cap forms a part of the cable guide and/or supplements it in a complementary manner. For instance, the cable guide may be made from a part of the plug casing and part of the plug casing cap, as with one partial or half-shell each, which together complement the circumferentially closed cable guide. The cable guide may be cylindrical, for example, to accommodate round cables.

To facilitate installation of the plug casing cap, the cap may be adapted for being latched to the end face of the plug casing. In this form, detent hooks and/or detent tabs may be formed on the plug casing cap, which may then be inserted into latch slots in the plug casing.

The present disclosure also relates to a method of producing/connecting/assembling a plug connector, particularly a high-current plug connector, in one or more of the variations described above. The method includes the following steps:

First of all, at least one electrical contact part is provided. The at least one electrical contact part has a sleeve with a receiving space on its inner side for a plug-in contact to be inserted in a direction of insertion. The at least one electrical contact part also has at least one contact spring affixed to the inner side of the sleeve. The contact spring is in sliding contact with a locking bolt that is displaceably guided or capable of being guided in the sleeve between a first end position and a second end position. In addition, a plug casing is provided to accommodate the contact part. Then a plug casing lock is inserted into the plug casing from a direction opposite the direction of insertion, i.e. along a longitudinal axis of the plug connector. The contact part, with an electric line attached to it, is then inserted into the plug casing. The line here is guided out of the plug casing perpendicularly to the direction of insertion or to the longitudinal axis of the plug connector. Then the plug casing is at least partly closed at the line-side end face by a plug casing cap that is latched to the plug casing from a direction perpendicular to the direction of insertion.

This method makes it possible to produce bipolar or multipolar plug connectors which, accordingly, have at least several contact parts.

The above-described properties, features and advantages of the present disclosure, as well as the manner in which they are achieved, will become clearer and more easily understood in the following schematic description of one form, and they are explained below in greater detail with reference to the drawings. It should be understood that the description and specific examples are intended for purposes of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawings, in which.

Figure 1:
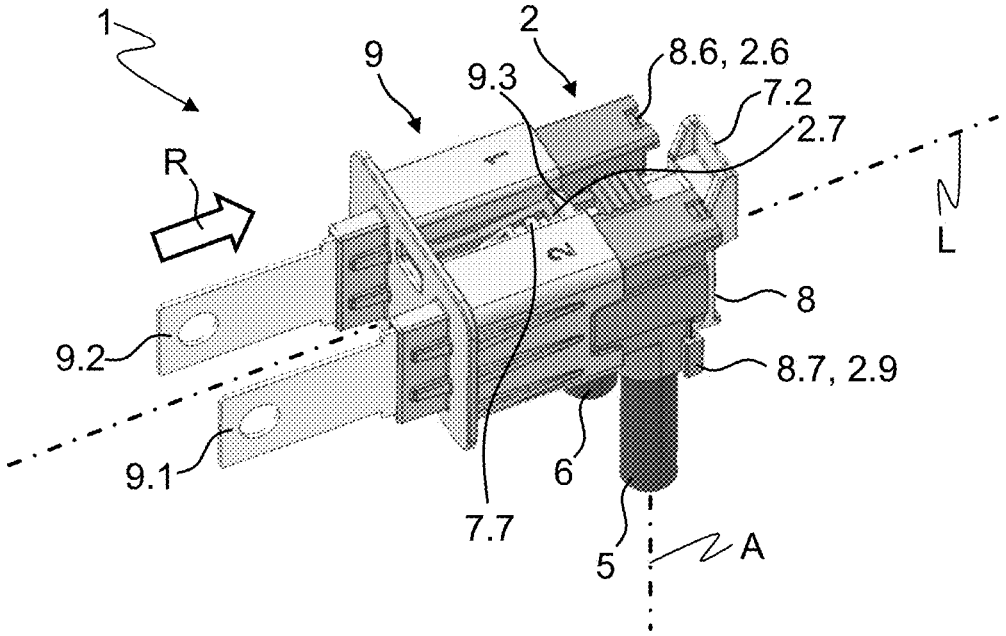
FIG. 1 shows a perspective view of a plug connector that is plugged into a header according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows a perspective view of a plug connector 1 that is arranged at an angle with regard to the orientation of its cable outlet A to its longitudinal axis L, since the cable outlet A is approximately perpendicular to the longitudinal axis L of the plug connector. In other words, the plug connector's longitudinal axis L and the line outlet A enclose an angle of ±90°.

The plug connector 1 is shown in FIG. 1 in a plugged condition. It is particularly well suited as a high-current plug connector to form a plug connection in an on-board electrical system of a vehicle. The plug connector 1 is shown here with two poles as an example. However, it may also be designed with a single pole or multiple poles.

The structure of the plug connector 1 will now be explained on the basis of the exploded view of the plug connector 1 shown in FIG. 2. The plug connector 1 in the two-pole variant shown here is essentially comprised of a plug casing 2, a first electrical (plug-in) contact part 3 accommodated therein, a second electrical (plug-in) contact part 4, a first electric line 5 attached to the first contact part 3, a second electric line 6 attached to the second contact part 4, a plug casing lock 7 functioning as a CPA (connector position assurance), a plug casing cap 8 and a socket part referred to as a header 9 and having a first plug-in contact 9.1 (see FIG. 1) and a second plug-in contact 9.2 (see FIG. 1). It follows that the first and the second plug-in contacts 9.1, 9.2 of the header 9 are plugged into the respective contact part 3, 4 in a direction of insertion R.

The plug casing 2 is configured to accommodate the two contact parts 3, 4 and at least a portion of the plug casing lock 7 interacting therewith, in a respective contact chamber part 2.1, 2.2. The contact parts 3, 4 are held in the plug casing 2 in such a way that they are primarily locked in the interior of the plug casing 2 and are thereby secured at least against movement along the longitudinal axis L of the plug connector. The plug casing cap 8 acts as a sort of secondary lock holding the contact parts 3, 4 in place in the contact chamber parts 2.1, 2.2. The plug casing lock 7 is accommodated in the plug casing 2 in such a way that it can be reciprocated along the plug connector's longitudinal axis L, between the plug casing 2 and the contact parts 3, 4.

Each contact chamber 2.1, 2.2 opens at an end face oriented away from the header 9 (the right-hand end face in FIG. 2) into a particular cable guide 2.3, 2.4 provided on the plug casing 2 and oriented in a direction perpendicular to the longitudinal axis L of the plug connector. Thus, the lines 5, 6 are guided out of the plug casing 2 in a direction perpendicular to the longitudinal axis L of the plug connector. It is noted that the cable guides 2.3, 2.4 are only partially closed in the circumferential direction of the lines 5, 6 and that they are completed by the plug casing cap 8 on the end face. For this the plug casing cap 8 has one cap section 8.1, 8.2 for each contact chamber part 2.1, 2.2, which closes the contact chamber parts 2.1, 2.2 at the end face oriented away from the header 9. It also has detent lugs 8.5, 8.6 at the free ends of the plug casing 2, which engage with complementary latch openings 2.5, 2.6 when in the installed state. Furthermore, to complete the cable guides 2.3, 2.4 the plug casing cap 8 also has a complementary, cap-side section with cable guides 8.3, 8.4 which in conjunction with the cable guides 2.3, 2.4 form a circumferentially closed cable guide.

In addition, a resilient detent tongue 2.7 extends away in the middle between the contact chambers 2.1, 2.2 in a direction opposite the direction of insertion R; it interacts with a latch web 9.3 of the header 9 to lock the plug casing 2 to the header 9 when in the plugged state (see FIG. 1), thus holding it by an undercut formed thereby.

As described and shown in DE 10 2015 104 377 A1 and DE 10 2015 104 378 A1, each contact part 3, 4 has a sleeve 3.1, 4.1; a contact spring 3.2, 4.2; a locking bolt 3.3, 4.3 and a plate-like, particularly strip-shaped contact tab 3.4, 4.4. On its inner side the sleeve 3.1, 4.1 forms a receiving space 3.5, 4.5 for the plug-in contact 9.1, 9.2 to be inserted in the direction of insertion R. The locking bolt 3.3, 4.3 is displaceable parallel to the direction of insertion R in a guide means formed by slots 3.6, 4.6 in the sleeve 3.1, 4.1. The ends of the slots 3.6, 4.6 form stops and hence end positions for the locking bolt 3.3, 4.3, which is at least partly in sliding contact with an upper surface of the contact spring 3.2, 4.2 between the two end positions. For the primary locking in the plug casing 2 the sleeve has a detent tongue 3.7, 3.8 on at least one flat side, that is a stamped and bent part to engage in an inside part of the plug casing 2.

Each line 5, 6 is attached to the particular contact tab 3.4, 4.4 of the contact parts 3, 4 in such a way that it exits perpendicularly to the longitudinal direction L along the cable outlet A. The ends of the lines 5, 6 are thus welded to the particular contact tab 3.4, 4.4 at an angle of 90° from the longitudinal direction L. The contact parts 3, 4 are turned around the longitudinal axis L by 90° relative to the plug casing 2, with the result that the contact parts 3, 4 are arranged lying or standing on a narrow side in the plug casing 2. In this way, it is also possible for the lines 5, 6 to exit perpendicularly without the contact part 3, 4 having to be constructively modified. In addition, longitudinal ends of the locking bolts 3.3, 4.3 also project from the sleeves 3.1, 4.1 perpendicularly to the longitudinal axis L.

Figure 2:
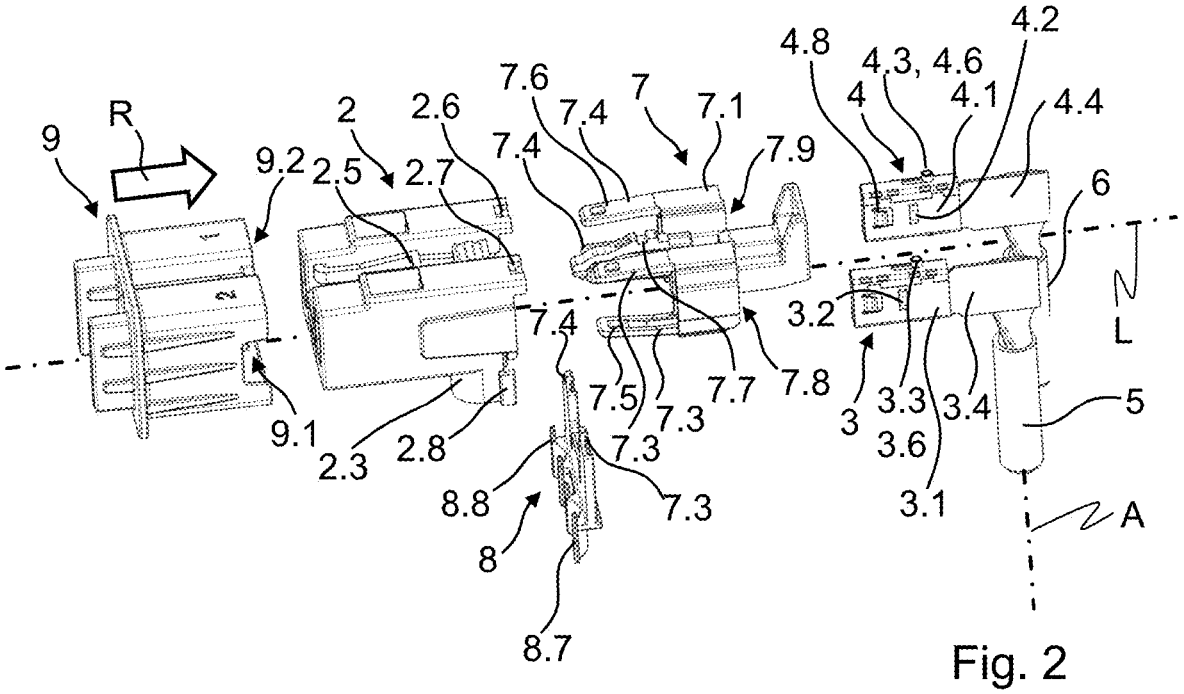
FIG. 2 shows a perspective exploded view of a plug connector according to the present disclosure.

The plug casing lock 7 has a main body 7.1, from which an operating tab 7.2 extends in the direction of insertion R, i.e. in a direction facing away from the header 9 (to the right in FIG. 2). The operating tab can also be moved past the plug casing cap 8 in the installed state, namely past its cap sections 8.1, 8.2, to allow actuation of the plug casing lock 7 for locking or unlocking action, as can be seen for the assembled state of the plug connector in FIG. 1. For each contact part 3, 4, a pair of complementary locking arms 7.3, 7.4 extends away from the main body 7.1 in a direction opposite the direction of insertion R. The locking arms 7.3, 7.4 slant toward each other in the direction of their free ends and toward the contact parts 3, 4, i.e. the space between diminishes in this direction. This not only facilitates insertion into the plug casing 2, but it also causes the particular contact part 3, 4 to be clamped fast and held in place between the pair of locking arms 7.3, 7.4. The locking arms 7.3, 7.4 have receiving slots 7.5, 7.6 at their free ends, that are designed to accommodate the longitudinal ends of the locking bolts 3.3, 3.4 in a positive fit, thus being able to interact with them. When in the installed state the locking bolts 3.3, 4.3 are therefore moved along by a movement of the plug casing lock 7, in that each locking bolt 3.3, 4.3 is guided on both sides by the particular pair of locking arms 7.3, 7.4 and is carried along with its movement. For enhanced clarity, not all reference numbers of the contact parts 3, 4 have been included in FIG. 2.

Furthermore, the plug casing lock 7 has a resilient locking tab 7.7 between the pairs of locking arms 7.3, 7.4 and extending away approximately in the middle from the main body 7.1 against the direction of insertion R. For example, it provides that the plug casing lock 7 can (only) be moved against the direction of insertion R if the plug-in contacts 9.1, 9.2 of the header 9 are plugged into the contact parts 3, 4, in order to avoid already locking the contact parts 3, 4 beforehand. In addition, (not until) in the assembled state, it also gives clearance for a movement of the plug casing 2 into a locked state in which the plug casing 2 is latched via the resilient detent tongue 2.7 to the latch web 9.3 of the header 9.

Figure 3:
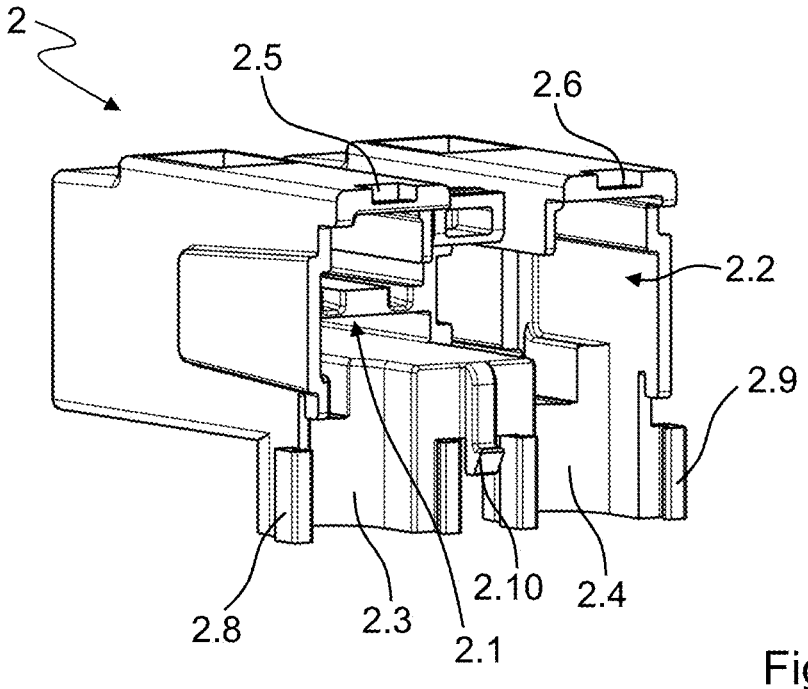
FIG. 3 shows a perspective view of a plug casing as a separate part according to the present disclosure.

FIG. 3 shows a perspective rear view of the plug casing 2 as a separate part. It can be seen that the contact chamber parts 2.1, 2.2 are designed to receive the contact parts 3, 4 on end, that is lying or standing on a narrow side. The cable guides 2.3, 2.4 on the casing side can also be more clearly recognized, and they are approximately in the shape of a half-shell in the direction of the header 9 and are complemented in the direction opposite the header 9 by the approximately half-shell cable guides 8.3, 8.4 formed on the cap side. FIG. 3 also shows that the plug casing cap 8 latches multiple times to the plug casing 2 in order to be held securely thereupon and to spare a secondary lock of the contact parts 3, 4. Thus, the plug casing cap 8 latches in at least three different places, namely with the detent lugs 8.5, 8.6 engaging in the latch openings 2.5, 2.6; with the detent overhangs 8.7, 8.8 latching to the latch channels 2.8, 2.9 and with a centric, transversely running latch edge 8.92 catching on a centric detent tab 2.10.

Figure 4:
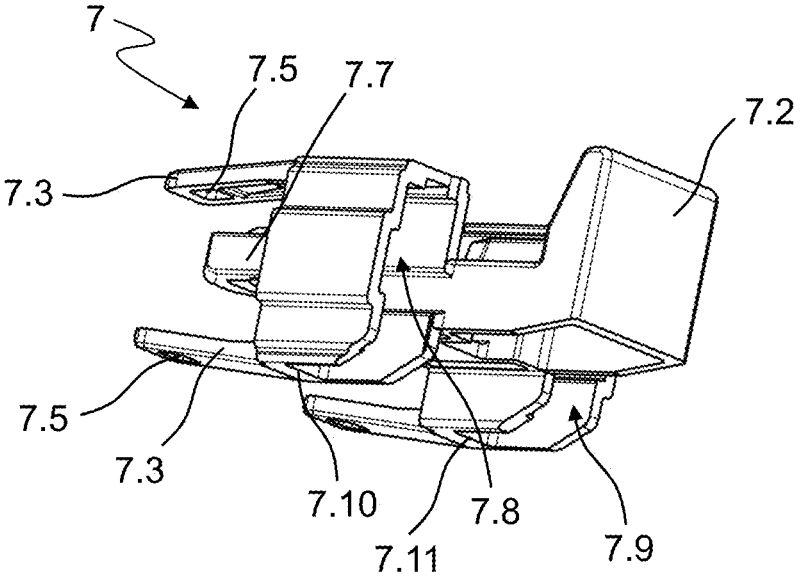
FIG. 4 shows a perspective view of a plug casing lock as a separate part according to the present disclosure.

FIG. 4 shows a perspective rear view of the plug casing lock 7 as a separate part. It can be seen that the locking arms 7.3, 7.4 slant toward one another in pairs. FIG. 4 also shows that the plug casing lock 7 has receiving chambers 7.8, 7.9 to accommodate the contact parts 3, 4, similar to the plug casing 2. However, the receiving chambers 7.8, 7.9 are dimensioned to permit movement of the plug casing lock 7 relative to the contact parts 3, 4. Moreover, it can be seen that for each line 5, 6 a cable guide recess 7.10, 7.11 is formed on the plug casing lock 7, in order that the lines 5, 6 may be inserted into the cable guides 2.3, 2.4 and 8.3, 8.4.

The production or assembly of the plug connector 1 can be described as follows. First of all, the contact parts 3, 4 are provided, with the lines 5, 6 attached to them at an angle. Before or after that the plug casing 2 is positioned to receive the contact parts 3, 4 and the plug casing lock 7. Accordingly, the plug casing lock 7 is inserted into the plug casing 2 along the longitudinal axis L of the plug connector, namely from a direction opposite the direction of insertion R (from the right in FIG. 2). Subsequently, the contact parts 3, 4 are inserted from the same direction into the plug casing 2 in which they are optionally primarily locked by mutual engagement. The lines 5, 6 here are guided out of the plug casing 2 along the cable guides 2.3, 2.4 perpendicularly to the longitudinal axis (L) of the plug connector. Finally, the plug casing is closed on the line-side end face (at the right end in FIG. 2) by the plug casing cap 8 at least in the area of the contact chamber parts 2.1, 2.2 and it is latched to the plug casing 2 from a direction perpendicular to the longitudinal axis L of the plug connector. Here the casing-side cable guides 2.3, 2.4 are supplemented by the cap-side cable guides 8.3, 8.4 in such a way that the cable outlet A is perpendicular to the longitudinal axis L of the plug connector.

Starting from the form presented above, the plug connector 1 and the method of its production can be modified in many ways. For example, the plug connector 1 can also be designed with one pole, that is, having only one contact part 3. Accordingly, in that case only one contact chamber part 2.1 and one cable guide 2.3 would then be created.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A plug connector comprising:

at least one electrical contact part, each electrical contact part comprising:

a sleeve defining a receiving space on an inner side of the sleeve configured for receiving a plug-in contact along a longitudinal axis of the plug connector; and at least one contact spring attached to the inner side of the sleeve, wherein the at least one contact spring is in sliding contact with a locking bolt configured to be guided in the sleeve between a first end position and a second end position;

an electric line attached to the at least one electrical contact part;

a plug casing accommodating the at least one electrical contact part and having at least one cable guide branching off perpendicularly to the longitudinal axis of the plug connector; and a plug casing lock at least partially grasping the at least one electrical contact part, wherein the plug casing lock is slidably accommodated in the plug casing and includes a cable guide recess, wherein the electric line attached to the contact part is guidable from the plug casing via the at least one cable guide and the cable guide recess perpendicularly to the longitudinal axis of the plug connector wherein the plug casing lock includes at least one locking arm positively grasping an end of the locking bolt projecting past the sleeve and in an installed state the locking bolt is carried along by a receiving slot of the locking bolt.

2. The plug connector according to claim 1, wherein the at least one electrical contact part includes a flat side and is arranged standing or lying on a narrow side in the plug casing.

3. The plug connector according to claim 1, wherein the at least one locking arm slants from a main body of the plug casing lock toward the longitudinal axis of the plug connector or the contact part.

4. The plug connector according to claim 1, wherein the plug casing lock includes at least one pair of locking arms that clamps and secures the at least one electrical contact part.

5. The plug connector according to claim 4, wherein the locking arms define receiving slots at their free ends to receive locking bolts of the electrical contact part.

6. The plug connector according to claim 4, wherein the plug casing lock further includes a resilient locking tab disposed between each pair of locking arms.

7. The plug connector according to claim 6, wherein the resilient locking tab is configured to allow the plug casing lock to move against an insertion direction (R) when the plug-in contact is inserted into the electrical contact part.

8. The plug connector according to claim 1, wherein the plug casing lock includes a main body and an operating tab extends from the main body in a direction of insertion (R).

9. The plug connector according to claim 1, wherein the plug casing is closed by a plug casing cap on an end face of the plug casing that is oriented away from a header, the plug casing cap being configured to hold the electrical contact part.

10. The plug connector according to claim 9, wherein the plug casing cap holds the electrical contact part in place while simultaneously allowing movement of a plug casing lock relative to the electrical contact part.

11. The plug connector according to claim 9, wherein the plug casing cap forms part of the cable guide.

12. The plug connector according to claim 9, wherein the plug casing cap is configured to be latched to the end face of the plug casing.

13. The plug connector according to claim 9, wherein the plug casing cap further includes at least one detent lug configured to engage with at least one latch opening of the plug casing.

14. The plug connector according to claim 9, wherein the plug casing cap further includes at least one detent overhang configured to latch to at least one latching channel of the plug casing.

15. The plug connector according to claim 9, wherein the plug casing cap further includes a centric latch edge configured to catch a centric detent tab of the plug casing such that the plug casing cap is secured to the plug casing.

16. The plug connector according to claim 1, wherein the sleeve of the electrical contact part includes a detent tongue configured to engage an inside part of the plug casing to lock the electrical contact part and the plug casing together.

17. The plug connector according to claim 1, wherein the plug casing includes a resilient detent tongue configured to latch a latching web of a header to lock the plug casing and the header together.

* * * * *